US006644981B2

(12) United States Patent
Choy

(10) Patent No.: US 6,644,981 B2
(45) Date of Patent: Nov. 11, 2003

(54) SOCKET FOR ELECTRICAL PARTS HAVING HORIZONTAL GUIDE PORTION

(75) Inventor: Conrad Choy, San Jose, CA (US)

(73) Assignee: Enplas Corporation, Saitama-ken (JP)

( * ) Notice: Subject to any disclaimer, the term of this patent is extended or adjusted under 35 U.S.C. 154(b) by 0 days.

(21) Appl. No.: 10/062,658

(22) Filed: Feb. 5, 2002

(65) Prior Publication Data

US 2003/0148650 A1 Aug. 7, 2003

(51) Int. Cl.[7] ..... H01R 12/00

(52) U.S. Cl. ..... 439/70; 439/71; 439/525; 439/526

(58) Field of Search ..... 439/70, 71, 525, 439/526

(56) References Cited

U.S. PATENT DOCUMENTS 4,936,783 A * 6/1990 Petersen ..... 439/526
5,066,245 A * 11/1991 Walker ..... 439/526
5,407,360 A * 4/1995 Belopolsky ..... 439/70
6,132,220 A * 10/2000 McHugh et al. ..... 439/526
6,196,849 B1 3/2001 Goodwin ..... 439/71

* cited by examiner

*Primary Examiner*—Tho D. Ta
(74) *Attorney, Agent, or Firm*—Staas & Halsey LLP

(57) ABSTRACT

A socket for an electrical part is provided with a socket body for accommodating an electrical part and a guide member is provided for the socket body so as to guide side surfaces of a body of the electrical part at the time of the accommodation thereof. The socket body is formed with a number of contact pins so as to be contacted to or separated from an electrode as a terminal of the electrical part. The guide member includes a plurality of guide portions, at least one of the guide portions being disposed so as to correspond to each of all the side surfaces of the electrical part body, respectively, and each of the guide portions has an elastic portion for elastically pressing inward the side surfaces.

20 Claims, 13 Drawing Sheets

SOCKET FOR ELECTRICAL PARTS HAVING HORIZONTAL GUIDE PORTION

BACKGROUND OF THE INVENTION

1. Field of the Invention

The present invention relates to a socket for an electrical part for detachably accommodating an electrical part such as a semiconductor device (called as "IC package" hereinafter), and more particularly, to a socket for an electrical part provided with a guide member or unit for guiding the electrical part to a predetermined position at a time of the accommodation thereof.

2. Related Prior Art

PRIOR ART

As a conventional "socket for electrical parts" of this kind, there is provided an IC socket for detachably accommodating an IC package as "electrical parts". This IC package is preliminarily set on a printed circuit board such that the IC package and the printed circuit board are electrically connected when the IC package is accommodated in the IC socket.

The IC package includes, for example, an LGA (Land Grid Array) type of IC package which has a rectangular-shape package body and a large number of plate-shaped electrodes as terminals mounted on a bottom surface of the package body.

On the other hand, the IC socket is provided with a number of contact pins, and the contact pins have upper contact portions, in an installed state, which contact the plate-shaped electrodes in a state that the IC package. is accommodated in the IC socket to thereby establish an electrical connection between the respective plate-shaped electrodes of the IC package and the printed circuit board through the contact pins, respectively.

One example of such structure, in which the IC package is easily aligned with the IC socket, is shown in the publication of U.S. Pat. No. 6,164,980. This known structure is provided,. as shown in FIG. 17, with first, second, third and fourth wall sections 116, 118, 120 and 122, which define a rectangular opening area for accommodating an IC package 126. The first wall section 116 is formed with a pair of elastic pieces 134 and 136 for applying first forces 142 and 144 to the IC package 126. Similarly, the second wall section 118 is also formed with a pair of elastic pieces 138 and 140 for applying second forces 146 to the IC package 126.

Furthermore, the third and fourth wall sections 120 and 122 are formed with contact points 128, 130 and 132, each having an outward protruded shape, which contact to the IC package 126.

According to the structure of FIG. 17 mentioned above, the IC package 126 is positioned through the forcible contact of the contact points 128, 130 and 132 by means of elastic pieces 134, 136, 138 and 140.

In such known structure, however, the IC package 126 is positioned, with reference to the contact points 128, 130 and 132 of the wall sections 120 and 122, by forcibly contacting (pressing) the IC package 126 to these contact points. Therefore, in a case where any error during the formation of the IC package 126 occurs, it is difficult to accord the center of the IC package 126 with the center of the accommodation of the IC package 126, and moreover, in a case where the IC package 126 is accommodated in a state shifted in position towards the sides of the wall sections 120 and 122, there is a fear that the IC package 126 may ride on the wall sections 120 and 122 and is hence not surely accommodated in the predetermined position.

SUMMARY OF THE INVENTION

An object of the present invention is to substantially eliminate defects or drawbacks encountered in the prior art described above and to provide a socket for electrical parts having a structure in which the center of the electrical part surely accords with the accommodation center thereof, and even if the electrical part is shifted in position at the accommodation thereof, the electrical part can be smoothly accommodated.

This and other objects can be achieved according to the present invention by providing a socket for an electrical part, which is provided with a socket body for accommodating an electrical part having a body having a surface to which an electrode is formed, and in which a guide member is provided for the socket body so as to guide side surfaces of the body of the electrical part at the time of the accommodation of the electrical part and the socket body is formed with a number of contact pins so as to be contacted to or separated from the electrode of the electrical part, wherein the guide member includes a plurality of guide portions disposed so as to correspond to the side surfaces of the electrical part body, respectively, each of the guide portions elastically pressing inward the side surfaces.

According to this structure, since the guide portions of the guide member are arranged for elastically pressing the respective side surfaces of the electrical part body, the electrical part can be guided to its predetermined position even if the electrical part is offset in any direction at the time of the accommodation. Furthermore, as mentioned above, since the respective side surfaces of the electrical part body are elastically pressed by the guide portions, the electrical part is subjected to the centering operation within the insertion area thereof and the center of the electrical part can surely accord with the center of the insertion area thereof.

In preferred embodiments of the above aspect, each of the guide portions is formed with an elastic piece which is elastically deformable and a pressing portion formed to a front end of the elastic piece, in which the pressing portion abuts against the side surface of the electrical part body so as to press the side surface thereof by an elastic force of the elastic piece.

At least one of the guide portions is arranged to one side surface of the electrical part body and at least other two guide portions are arranged to another side surface opposite to the one side surface across the electrical part body, the other two guide portions also being each disposed along the long direction of the another side surface and at each both outside portions, of the another side surface, from a position opposite to the one of the guide portions across the electrical part body.

Another aspect of the present invention is that one of the guide portions is arranged to one side surface of the electrical part body and other two guide portions are arranged to another side surface opposite to the one side surface across the electrical part body, the other two guide portions also being each disposed along the long direction of the another side surface and at each both outside portions, of the another side surface, from a position opposite to the one of the guide portions across the electrical part body.

And a plurality of guide portions can be at least arranged to one of the side surfaces.

Still another aspect of the present invention is that at least one of the guide portions is arranged to each of both outside portions, from a central portion and along the long direction, of one of the side surfaces of the electrical part body, and at least other two guide portions are each arranged to another side surface of the electrical part body opposite to the one of the side surfaces thereof at each position opposite, across the electrical part body, to boss of the guide portions arranged to the one of the side surfaces so that the electrical part body is clamped between the guide portions arranged to the one of the side surfaces and the guide portions arranged to the another side surface.

Still another aspect of the present invention is that a socket for an electrical part according to claim 1, wherein two guide portions is each arranged to each of both outside portions, from a central portion and along the long direction, of one of the side surfaces of the electrical part body, and other two guide portions are each arranged to another side surface of the electrical part body opposite to the one of the side surfaces thereof at each position opposite, across the electrical part body, to the two guide portions arranged to the one of the side surfaces so that the electrical part body is clamped between the two guide portions arranged to the one of the side surfaces and the other two guide portions arranged to the another side surface.

And a plurality of guide portions can be at least arranged to one of the side surfaces.

The guide portions are formed to respective sides of a frame member having a central opening having a size suitable for accommodating the electrical part, therein, the frame member being mounted, to be detachable, to the socket body.

According to the above preferred embodiments of the present invention, since the guide member is formed of the elastic piece having the front end to which the pressing portion is formed, the guide member can be easily formed through an integral formation of such as resin material.

Furthermore, since the guide portion is formed with the elastic property, any force to rotate the electrical part with respect to the area in which the electrical part is accommodated can be prevented from causing, and the electrical part can be hence smoothly guided and stably accommodated.

Still furthermore, since the electrical part can be supported by equal forces applied from a plurality of directions, the electrical part can be further smoothly guided and accommodated.

Even in a case where a plurality of electrical parts having different outer shapes are to be accommodated, it is not necessary to change the socket body by preparing a plurality of frame structures having difference central openings corresponding to the electrical parts, respectively.

In a modified aspect of the present invention, there will be provided a socket for an electrical part comprising:

a socket body for accommodating an electrical part having a body having a surface to which an electrode is formed;

a guide member having a frame structure provided for the socket body for guiding a side surface of the electrical part body at a time of the accommodation of the electrical part; and a number of contact pins provided for the socket body so as to be contacted to or separated from the electrode of the electrical part, the guide member including a plurality of guide portions disposed at side portions of the frame structure thereof so as to correspond to the side surfaces of the electrical part body, respectively, each of the guide portion having an elastic portion to press inward the side surface of the electrical part body.

According to this modified aspect, substantially the same function and effect as that mentioned above will be achieved.

The nature and further characteristic features of the present invention. will be made more clear from the descriptions made with reference to the accompanying drawings.

DESCRIPTION OF THE PREFERRED EMBODIMENTS

Figure 1:
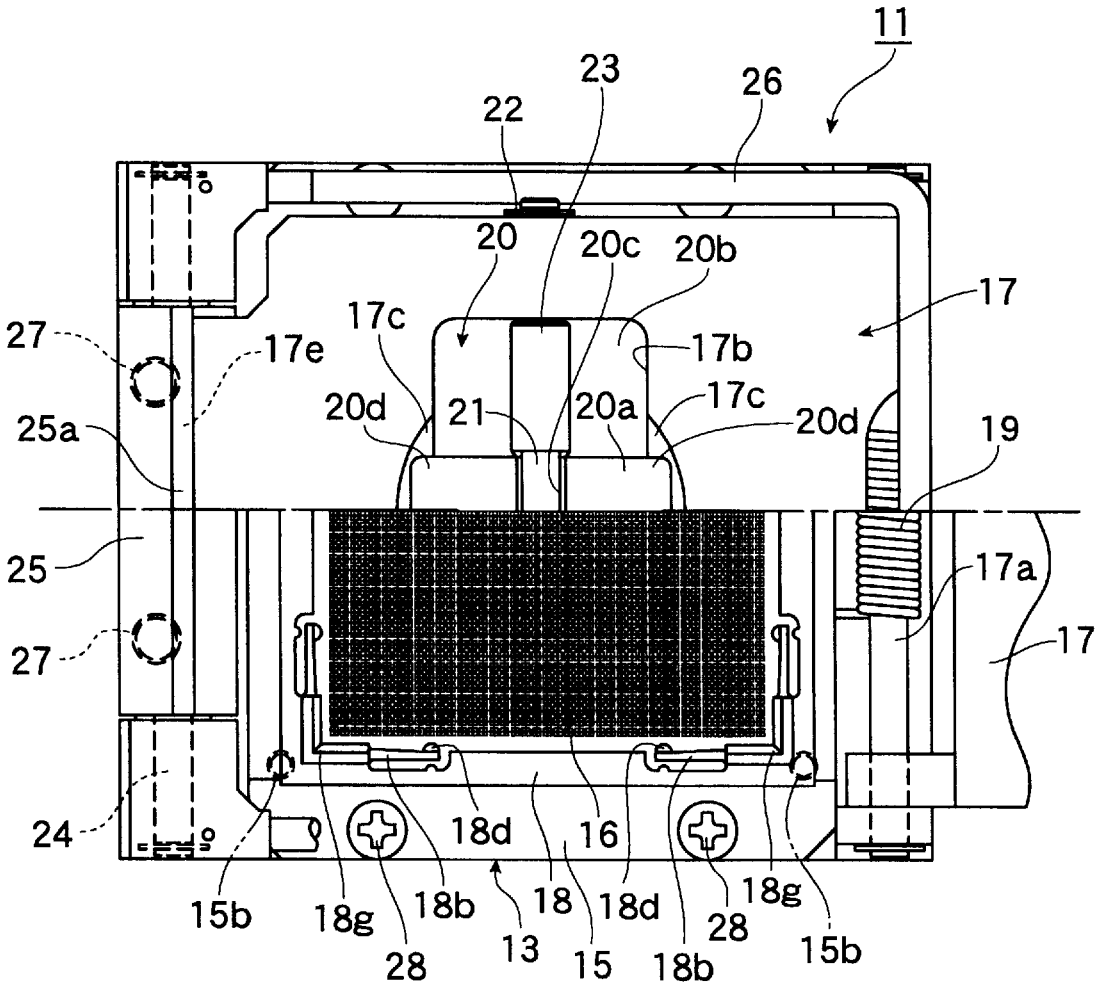
FIG. 1 is a plan view of an IC socket as a socket for an electrical part according to one embodiment of the present invention, in which a lower half of an open/close member of the IC socket is opened.

The present invention will be described more in detail hereunder with reference to the accompanying drawings.

In the drawings, reference numeral 11 denotes an IC socket which is utilized for a performance test of an IC package 12, and for this purpose, it is used for electrically connecting a plate-shaped electrode 12*b* as terminal of the IC package 12 and a printed circuit board P of an IC test device.

This IC package 12 is a so-called LGA (Land Grid Array) and has a rectangular plate or a plate-like shape. The IC package 12 is composed of a package body 12*a* having four side portions 12*c* and a lower surface on which a number of plate-shaped electrodes 12*b* are arranged in a matrix as terminals.

Figure 4:
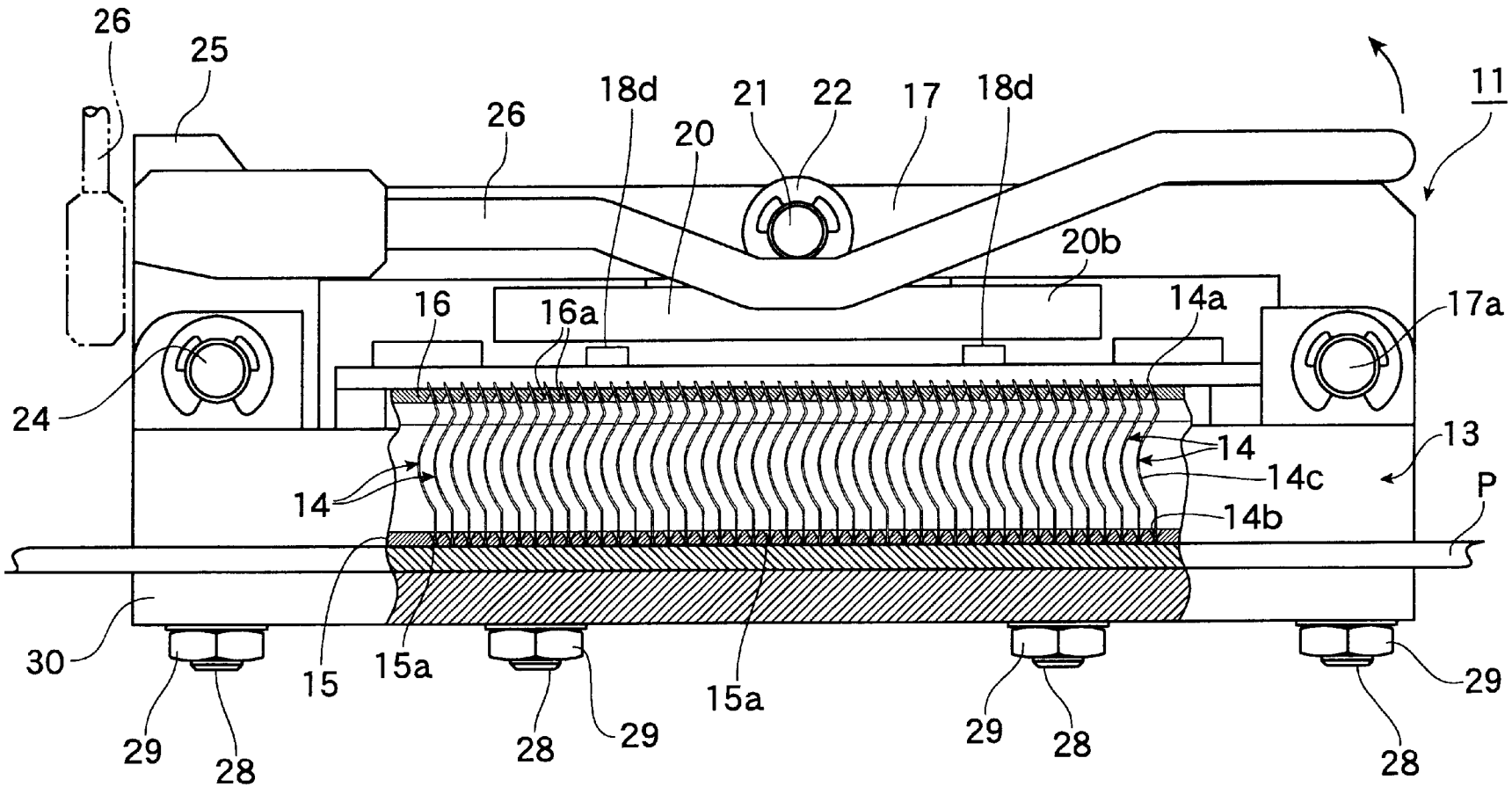
FIG. 4 is a front view of the IC socket having a broken-away portion for showing contact pin arrangement.

On the other hand, as shown in FIG. 4, the IC socket 11 is composed of a socket body 13 which is mounted on the printed circuit board P such as burn-in-board, and a number of contact pins 14, contacting the plate-shaped electrodes 12*b*, are formed to this socket body 13.

The socket body 13 is composed of a base portion 15 and an upper plate 16 which is urged upward by means of a spring 15*b* disposed above the base portion 15 with a predetermined space, the upper plate 16 being vertically movable with respect to the base portion 15. The base portion 15 is formed with lower side through holes 15*a* and the upper plate 16 is formed with upper side through holes 16*a*.

Figure 7:
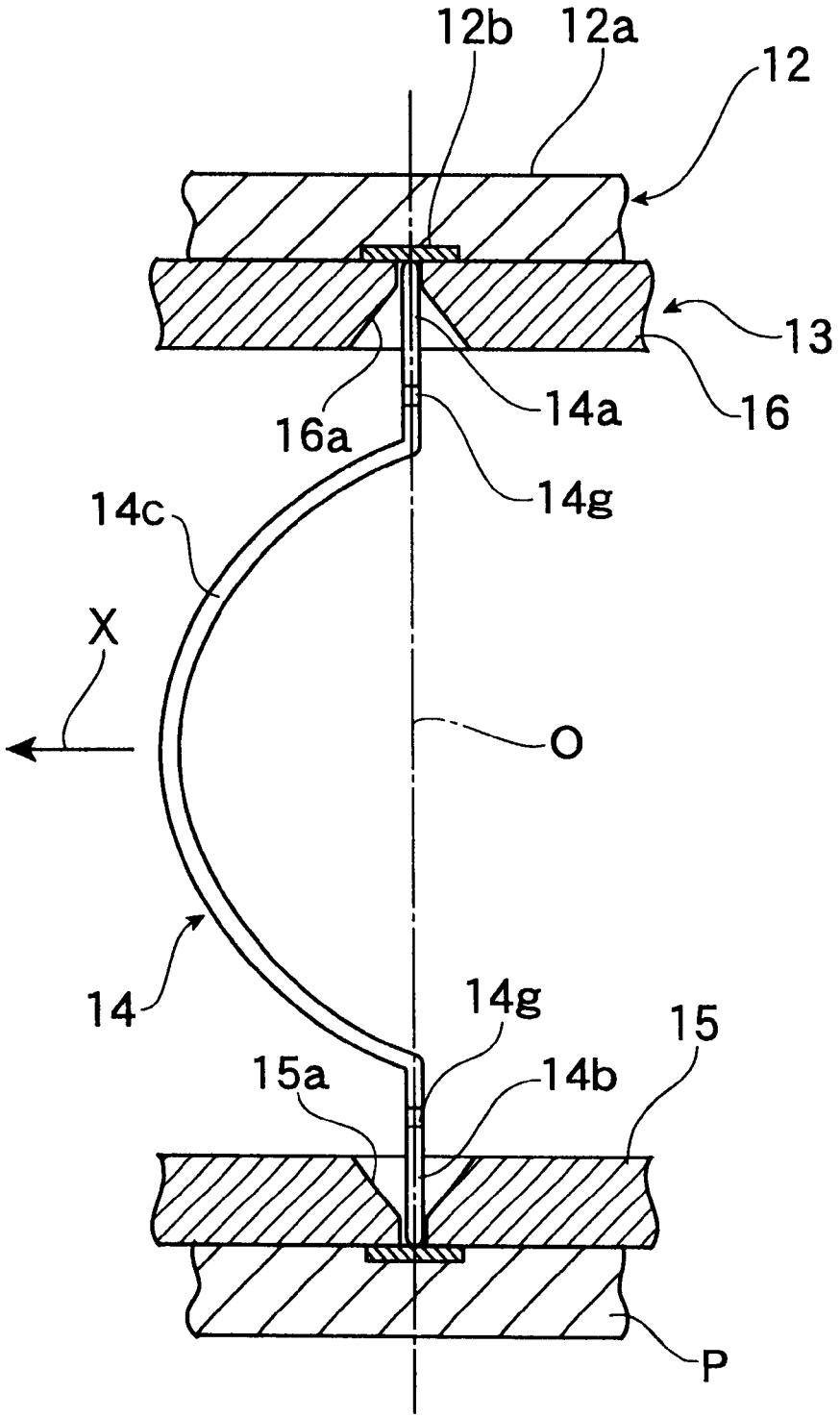
FIG. 7 is a sectional view showing an arrangement of the contact pins of the IC socket of FIG. 1 in a state that the IC socket is mounted to a printed circuit board and an IC package as electrical part is accommodated in the IC socket.

As shown in FIG. 7, each of the contact pins 14 is formed from a fine long plate-shaped member having an electrical conductivity by bending the same through a press working so as to provide an arcuate (semi-circular) shape having an elastic portion 14*c* formed between upper and lower end portions 14*a* and 14*b*. The circular shape is flexed in a direction of an arrow X in FIG. 7.

Furthermore, in the state that the elastic portion 14*c* is bent in the circular shape between the upper and lower end portions 14*a* and 14*b* of the contact pin 14, the upper end portion 14*a* is inserted into the upper through hole 16*a* formed to the upper plate 16 and the lower end portion 14*b* is also inserted into the lower through hole 15*a* formed to the base portion 15.

In a state before the IC package 12 is accommodated in the IC socket 11, the upper end portion 14*a* of the contact pin 14 projects upward through the upper through hole 16*a* formed to the upper plate 16, and on the other hand, in a state after the mounting to the printed circuit board P, the lower end portion 14*b* of the contact pin 14 projects downward through the lower through hole 15*a* formed to the base portion 15.

Furthermore, to the upper plate 16 is mounted by a guide member 18 as shown in FIGS. 8 to 14 for guiding the IC package 12 at a time of accommodating the same to the socket body 13 of the IC socket 11.

The guide member 18 provides a frame shape (framed structure) formed with a rectangular central opening having a size capable of accommodating the IC package 12 therein. The frame-shaped guide member 18 is composed of four side portions 18*a* each corresponding to each of four side portions 12*c* of the IC package 12, and a pair of guide portions 18*b* are formed to each side portion 18*a*.

Each of the, guide portions 18b has an elastic piece 18*c* having a front end portion to which a pressing portion 18*d* is formed so that the pressing portion 18*d* abuts against the side surface 12*c* of the IC package body 12*a* to thereby urge inward the side surface 12*c* by the urging force of the elastic piece 18*c*.

Figure 8:
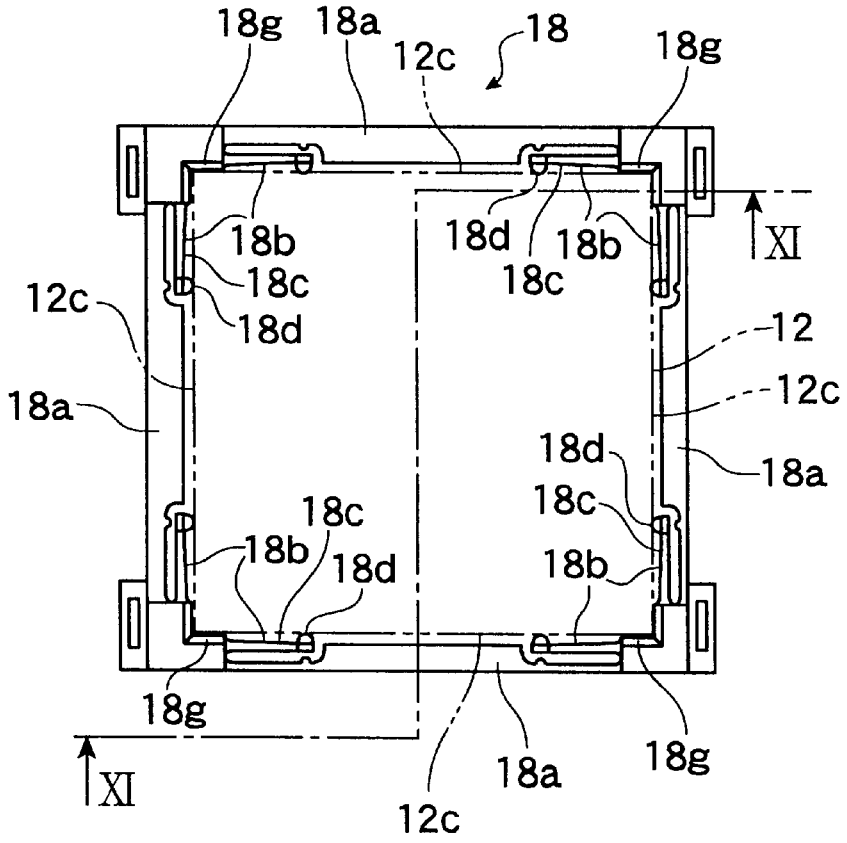
FIG. 8 is a plan view of a guide member of the IC socket of FIG. 1.
Figure 9:
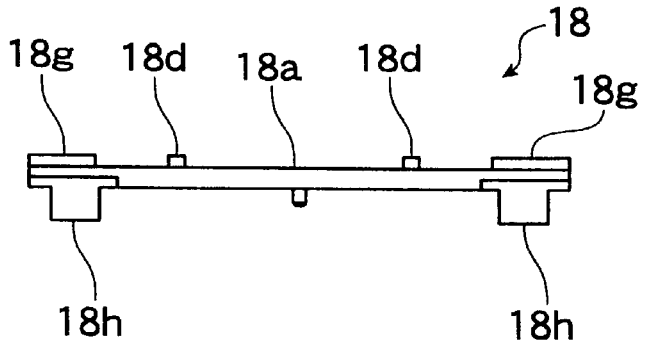
FIG. 9 is a right-side view of FIG. 8.
Figure 10:
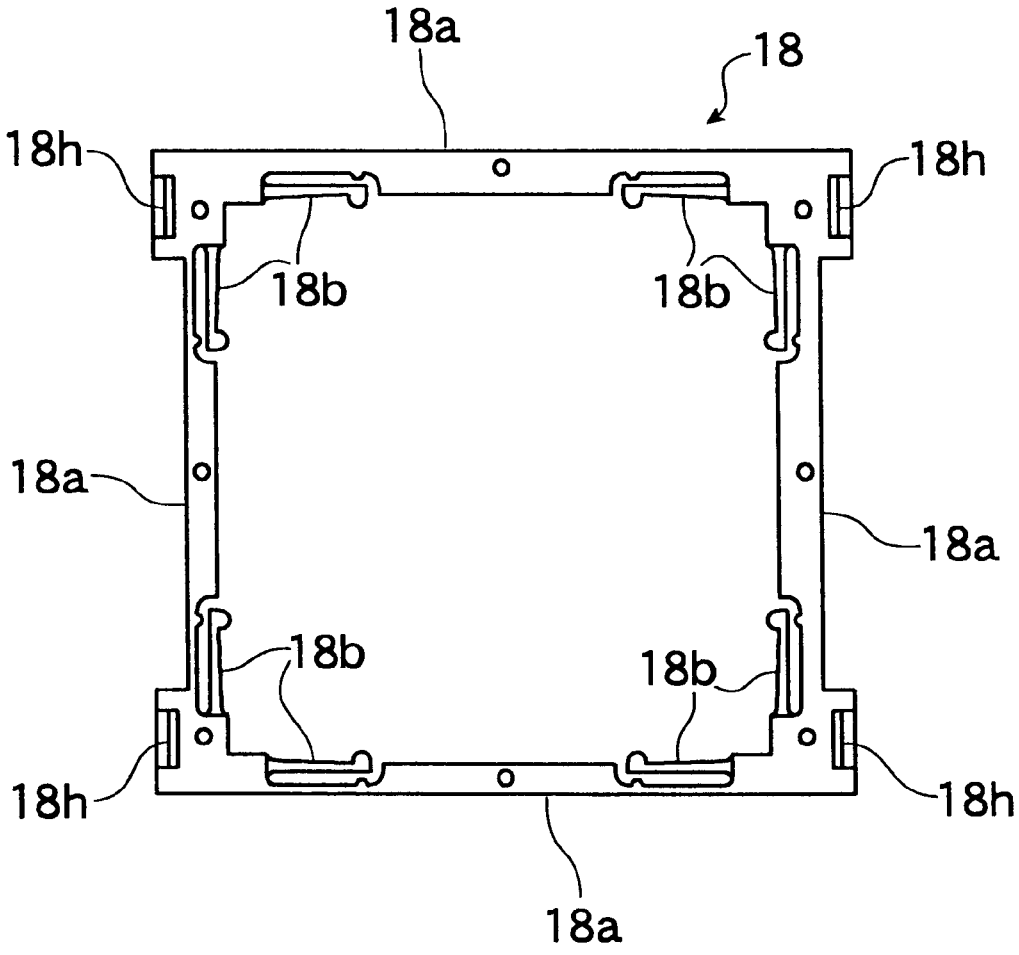
FIG. 10 is a bottom view of the guide member of the IC socket of FIG. 1.
Figure 11:
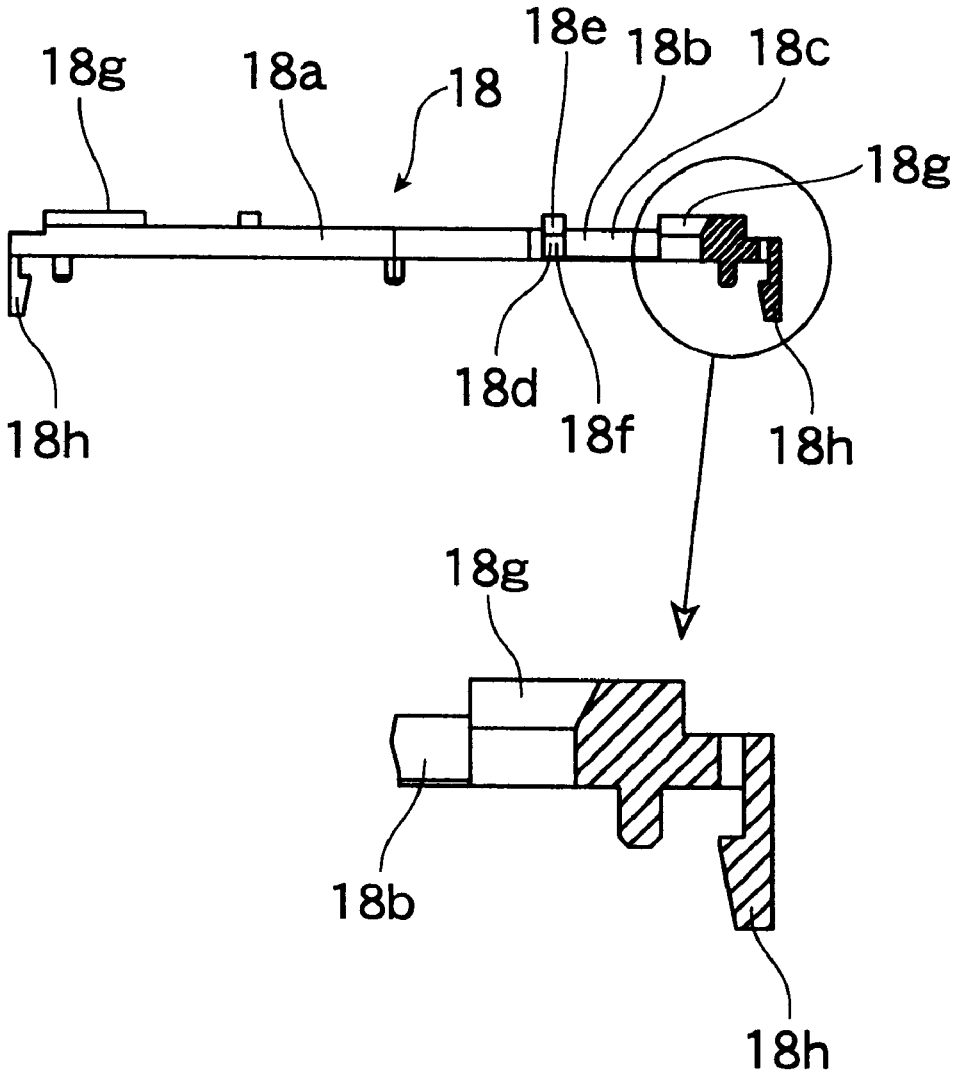
FIG. 11 is a sectional view taken along the line XI—XI of FIG. 8.

As shown in FIGS. 8 to 10, each of the pressing portions 18*d* is positioned apart outward from a central portion of the side portion 18*a* by a predetermined distance, (that is, the pressing portions 18*d* is formed to the front end portion of the guide portion 18*b* extending towards the central portion of the side portion 18*d* ), so as to press the side surface 12*c* of the IC package 12 at a portion outer side from the central portion of the side surface 12*c*. These pressing portions 18*d* are formed in the opposing manner with respect to the opposing side surfaces so as to surely clamp the package body 12*a* therebetween.

As mentioned above, a pair of guide portions 18*b* are formed to each of the side portions 18*a* of the guide member 18 so that the pressing portions 18*d* abut at two points on each side surface 12*c* of the IC package 12. Further, the urging forces, i.e., the elastic forces of the elastic pieces 18*c*, of the respective guide portions 18*b* are set to be equal to each other.

Figure 12:
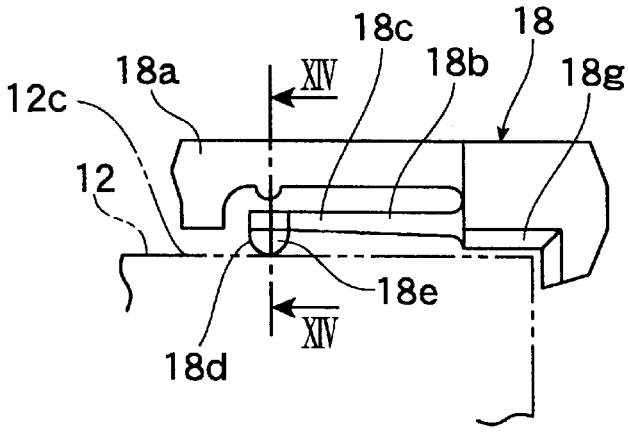
FIG. 12 is a plan view showing the guide member in an enlarged scale.
Figure 13:
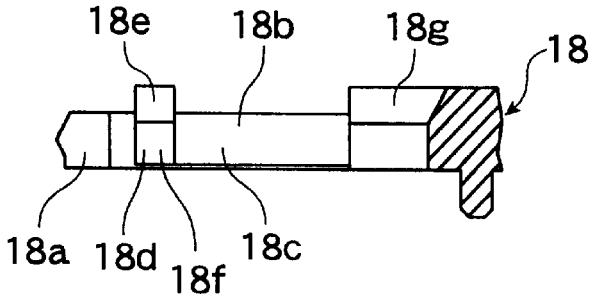
FIG. 13 is a front view in connection with FIG. 12.
Figure 14:
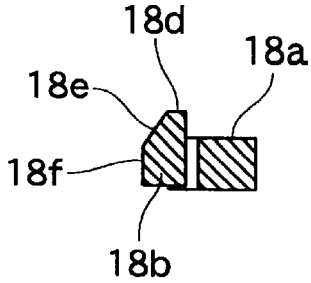
FIG. 14 is a sectional view taken along the line XIV—XIV of FIG. 12.

Still furthermore, as shown in FIGS. 12 to 14, the pressing portion 18*d* is formed, at its upper portion, with a tapered guide surface 18*e* by which the side surface 12*c* of the IC package 12 is guided.

In addition, the guide member 18 is also formed with corner guide portions 18*g* for guiding respective corner portions of the rectangular plate of the IC package 12. The guide member 18 is detachably engaged with the upper plate 16 by engaging pieces 18*h*, having elastic property, formed to the respective corner portions of the rectangular frame structure.

According to the structure mentioned above, it is possible to eliminate the preparation of a plurality of IC sockets 11 corresponding to a plurality of IC packages having different outer shapes by preparing a plurality of guide members having openings corresponding to the outer shapes of the respective IC packages 12 and it is hence possible to prepare only one IC socket 11.

Figure 2:
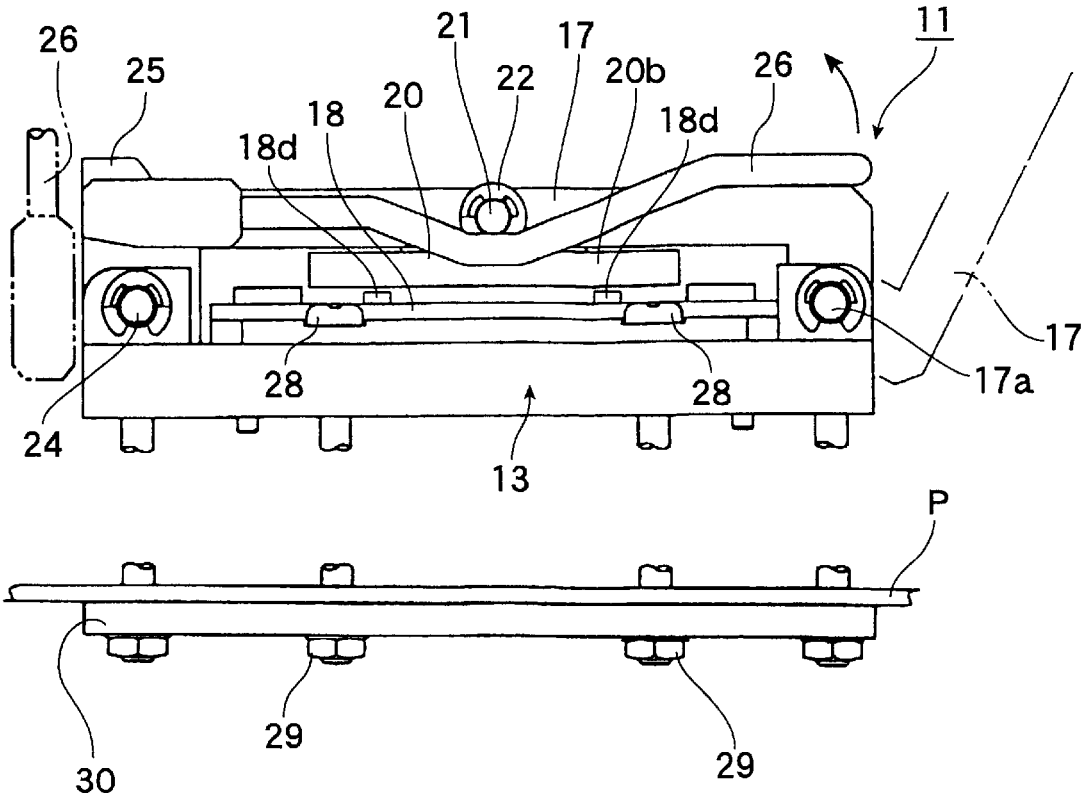
FIG. 2 is a front view of the IC socket of FIG. 1.
Figure 3:
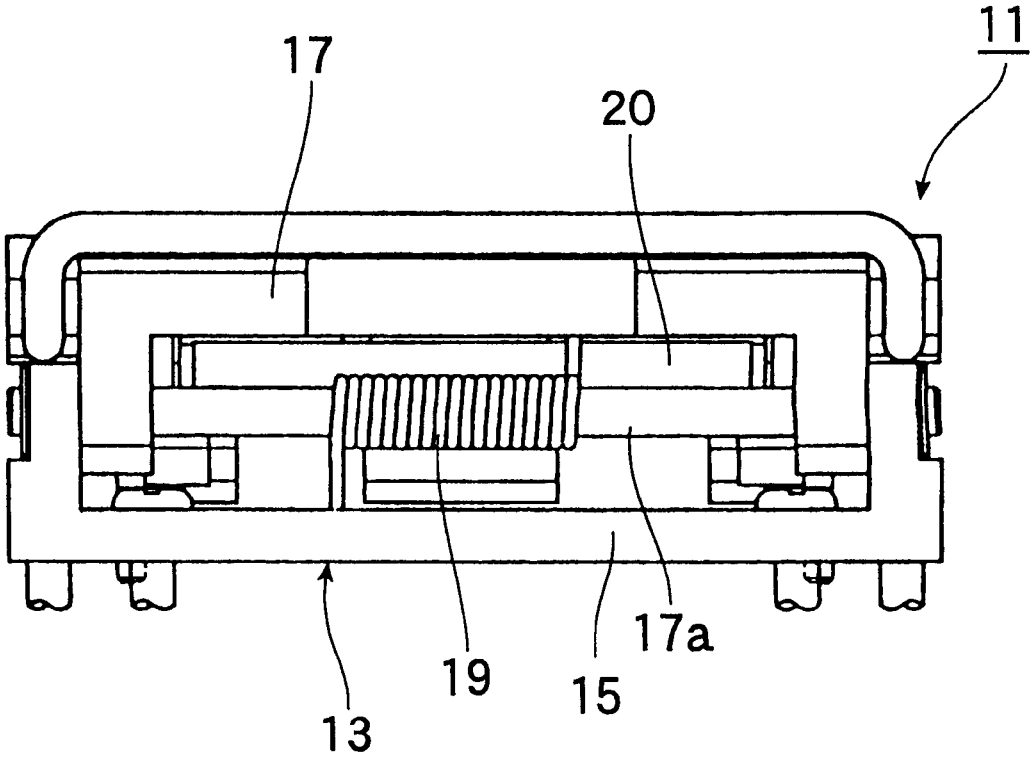
FIG. 3 is a right-side view of the IC socket of FIG. 1.

On the other hand, the open/close member 17 is mounted, as shown in FIGS. 1 to 4, to the base portion 15 of the socket body 13 to be rotatable by means of shaft or pin 17*a*, and the open/close member 17 is urged by means of spring 19 in the opening direction (i.e., clockwise direction in FIGS. 2 and 4). A pressing member 20 pressing the IC package 12 is provided for this open/close member 17.

The open/close member 17 is formed, at its central portion, with an opening 17*b* in which a support portion 20*a* of the pressing member 20 is arranged.

Figure 5:
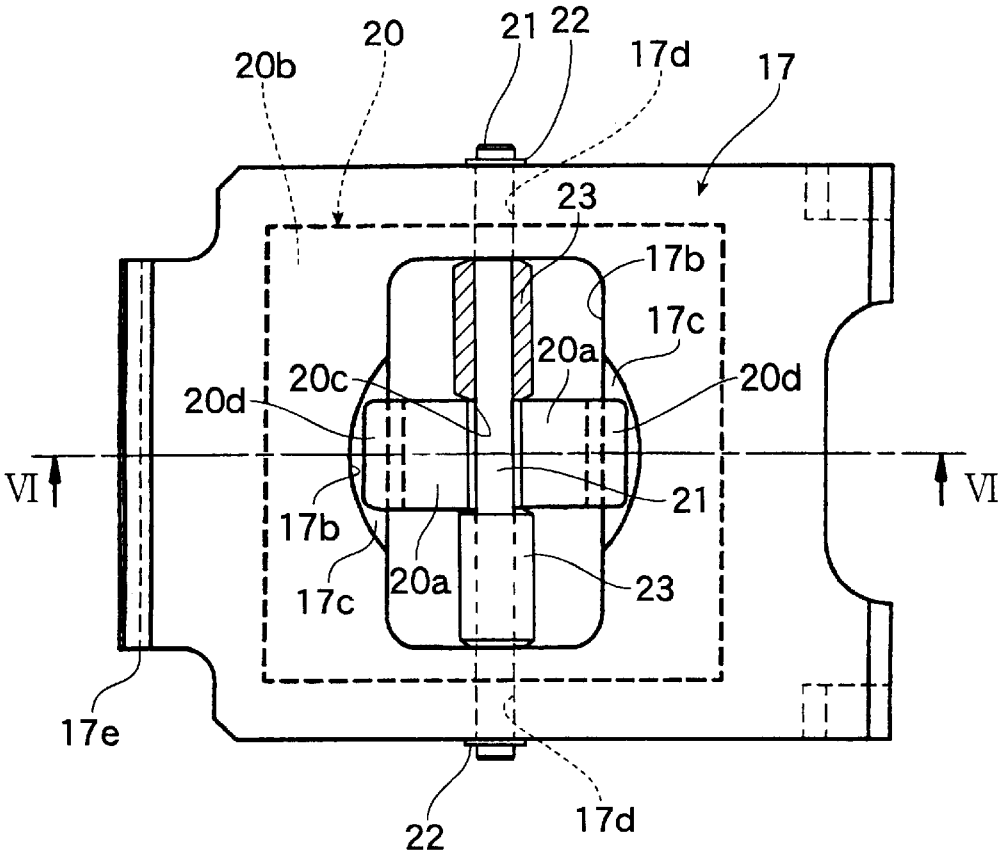
FIG. 5 is a plan view showing the open/close member, press (pressing) member. and so on of the IC socket.
Figure 6:
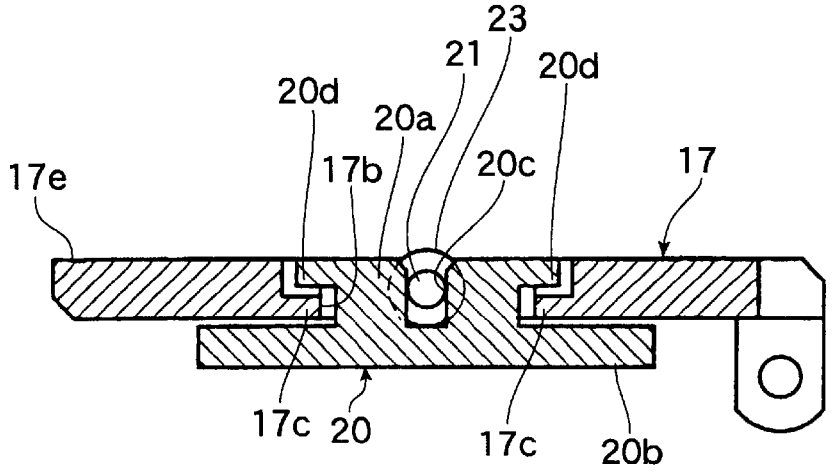
FIG. 6 is a sectional view taken along the line VI—VI of FIG. 5.

As also shown in FIGS. 4 to 6, the pressing member 20 is provided with a rectangular press plate portion 20*b* having a size corresponding to the size of the package body 12*a* of the IC package 12, and a pair of support portions 20*a* project from approximately central portion of the upper surface of the press plate portion 20*b*.

The paired support portions 20*a* is formed with engaging portions 20*d* projecting sideways as shown in FIG. 6, and these engaging portions 20*d* are engaged with engagement portions 17*c* formed to the peripheral edge portion of the opening 17*b* of the open/close member 17, whereby the pressing member 20 is supported by the open/close member 17.

Furthermore, as also shown in FIG. 6, there is formed a slit 20*c* extending in the vertical direction between the paired support portions 20*a* in the closed state of the open/close member 17 (i.e., a state along substantially horizontal direction). The shaft 21 is inserted into this slit 20*c* and is then inserted through an insertion hole 17*d* of the open/close member 17. E-rings 22 are provided to be detachably for the shaft 21 at both positions of the open/close member 17, and when the E-rings 22 are removed, the shaft 21 can be withdrawn (see FIG. 5).

Therefore, in the closed state of the open/close member 17, the pressing member 20 is movable in the vertical direction through the insertion of the shaft 21 to the slit 20*c* of the support portion 20*a*. The shaft 21 is then inserted through, as shown in FIG. 5, a spacer 23 and the pressing member 20 is pressed through the spacer 23.

On the side of the base portion 15, as shown in FIGS. 1, 2 and 4, a latch 25 is provided to be rotatable by means of shaft 24, and a hook portion 25*a* formed to the front end (upper end) portion of the latch 25 is engaged with the front end portion 17*e* of the open/close member 17. The latch member 25 is vertically moved and rotated by a mechanism, not shown, through a rotation of an arm 26 rotatably mounted to a shaft or pin 24. The latch 25 is urged upward with respect to the socket body 13 by means of spring 27.

The socket for electrical part of the structure mentioned above will operates in the following manner.

At a time of actual use, the IC socket 11 is disposed on the printed circuit board P, as shown in FIG. 4, by means of screws 28 and nut 29 through a support plate 30. The IC package 12 is accommodated in the IC socket 11 as follows.

First, as shown in FIG. 2, the arm 26 now in a horizontal state is rotated in the counterclockwise direction (direction shown by an arrow in FIG. 2) to a vertically standing state (state shown with dot and dash line).

According to this rotational motion of the arm 26, the latch 25 pressed to a lowermost position by the not-shown mechanism is pressed upward by means of spring 27 to thereby move the latch 25 upward, and hence, the latch 25 and the open/close member 17 are partially (incompletely) engaged.

When the arm 26 is further rotated in the counterclockwise direction, the engagement between the hook portion 25*a* of the latch 25 and the front end portion 17*e* of the open/close member 17 is released. Accordingly, the open/close member 17 is rotated in a direction to be opened (clockwise direction in FIG. 2) by the spring 19, and when opened, the IC package 12 is accommodated to the guide member 18 (see lower half state of FIG. 1).

Further, after the releasing of the engagement between the open/close member 17 and the latch 25, when a force to rotate the arm 26 in the counterclockwise direction is released, the arm 26 returns to its standing position as shown in FIG. 2 with the dot and dash line, and in this time, the latch 25 is also returned to its standing position.

That is, with reference to FIGS. 8, 10, 12, 13 and 14, when the IC package 12 is lowered to the guide member 18, the respective corner portions of the package body 12*a* are guided by the corner guide portions 18*g* of the guide member 18, and at the same time, the side surfaces 12*c* of the package body 12*a* are guided by the corner guide portions 18*g*, respectively. Then, in a case where the side portions of the package body 12*a* slide on the guide surfaces of the guide portions 18*g*, respectively, the elastic pieces 18*c* are elastically deformed outward, so that the elastic pieces 18*c* are guided to the vertical wall sections 18*f* of the pressing portions 18*d* . Accordingly, if the inserting position of the IC package 12 is slightly shifted, the IC package 12 is guided to the guide surfaces 18*e*. In this case, since the guide portions 18*b*, which are elastically deformable, are formed so as to correspond respectively to the surrounding four side surfaces 12*c* of the IC package 12, even if the IC package 12 be shifted in any direction, it can be guided to the vertical wall section 18*f* of the pressing portion 18*d*.

In addition, since the four side surfaces 12*c* of the IC package 12 are elastically pressed by the guide portions 18*b*, respectively, the IC package 12 is subjected to the centering operation and, then, the center of the IC package 12 and the center of insertion range thereof accord with each other.

Furthermore, two guide portions 18*b* are formed to the respective side portions 18*a* of the guide member 18, and the side surfaces 12*c* of the IC package 12 are pressed at two points, whereby a force for rotating the IC package 12 with respect to the frame-shaped guide member 18 less acts, and the side surfaces 12*c* of the IC package 12 and the respective side portions 18*a* of the guide member 18 can be positioned in a parallel state.

According to the manner mentioned above, the IC package 12 is placed to a predetermined position on the upper plate 16 by the operation of the guide member 18.

Thereafter, the open/close member 17 is rotated in the closed direction (i.e., counterclockwise direction in FIG. 2), and the front end portion 17*e* of the open/close member 17 is engaged with the hook portion 25*a* of the latch 25. Subsequently, when the arm 26, which now has the standing state shown with the dot and dash line in FIG. 2, is rotated clockwisely to substantially the horizontal position shown with the solid line in FIG. 2, the latch 25 is moved to the lowermost position against the urging force of the spring 27, and the open/close member 17 and the latch 25 are completely engaged. At this time, the upper surface of the package body 12*a* is pressed downward by the press plate portion 20*b* of the pressing member 20 provided for the open/close member 17. Accordingly, the elastic portion 14*c*. of the contact pin 14 contacting the plate-shaped electrode 12*b* of the IC package 12 is elastically deformed, and according to this elastic force, the plate-shaped electrode 12*b* and the upper end portion 14*a* of the contact pin 14 are electrically connected, and simultaneously, the lower end portion 14*b* of the contact pin 14 and the electrode formed to the printed circuit board P are also electrically connected as shown in the state of FIG. 7.

Figure 15:
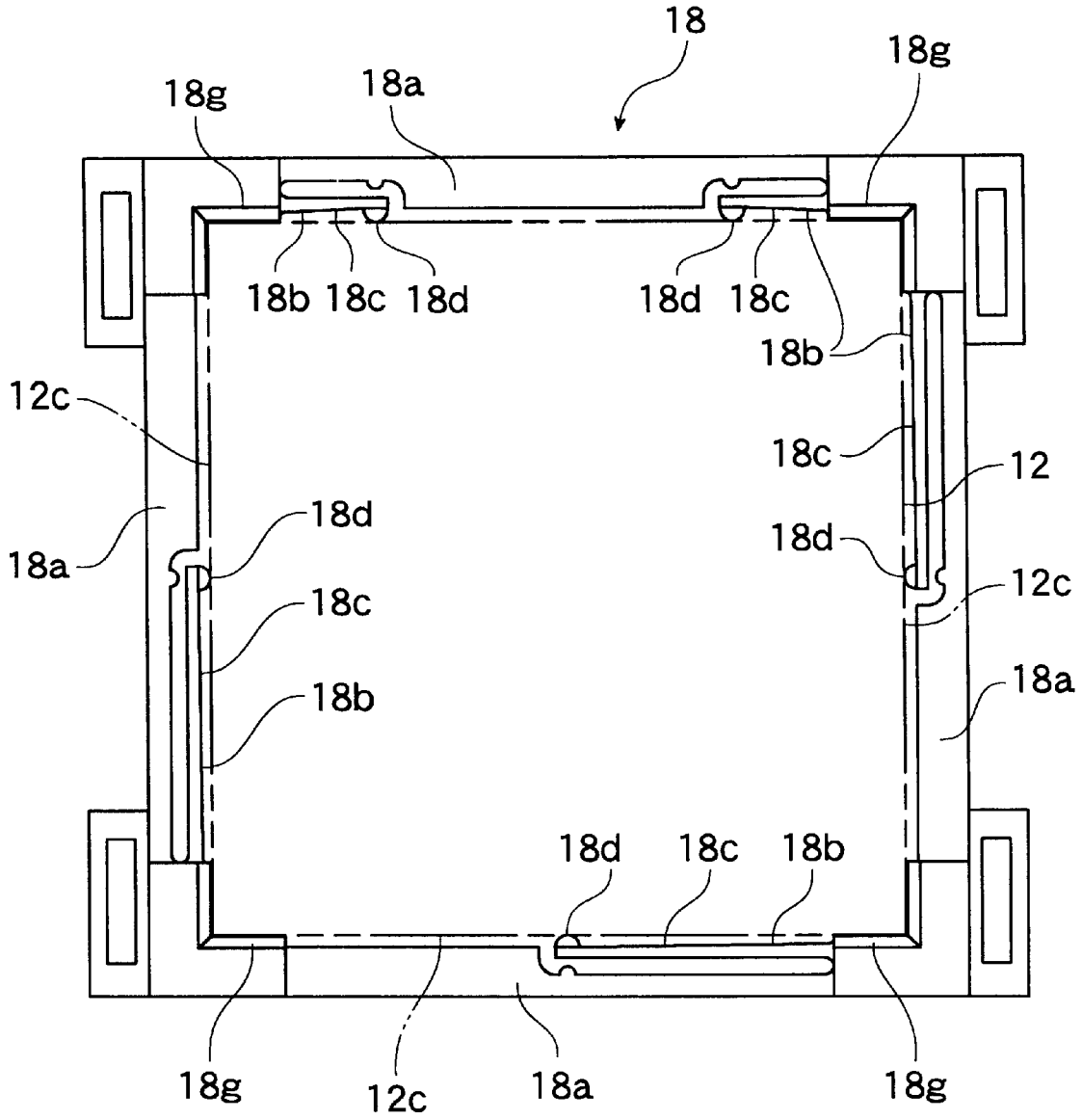
FIG. 15 is a plan view of a variation of a guide member of the IC socket.

Further, in addition to the embodiment described above, the present invention can adopt an arrangement, for example, as shown in FIG. 15, of the guide portions 18*b* (pressing portions 18*d* ) for acting no force to rotate the IC package 12. FIG. 15 shows a variation of the guide member shown in FIG. 8. That is, at least one pressing portion 18*d* is arranged with respect to one of the side surfaces 12*c* of the package body 12*a*, and in addition, at least one pressing portion 18*d* is arranged to each of both side portions outside the position corresponding to the pressing portion arranged to that one side surface with respect to the other side surface 12*c*. opposing to that side surface 12*c* of the package body 12*a*.

In addition, a plurality of guide portions can be further positioned adjacently in the vicinity of the guide portions in FIG. 15.

Concerning vectors of the pressing portions opposite to each other across the electrical part body in FIG. 15, the direction of each vector across the electrical part body is just at least opposite to each other and parallel to the center line of the socket body.

Furthermore, in the embodiment described above, the guide portions 18*b* are integrally formed to the guide member 18. The present invention, however, is not limited to such embodiment, and as shown in FIG. 16 (FIG. 16 shows another variation of the guide member shown in FIG. 8.), only one guide portion 18*b* can be formed to each side portion 18*a* of the guide member 18 in the mere consideration that the IC package is elastically supported in the centering state with respect to the guide member 18.

Figure 16:
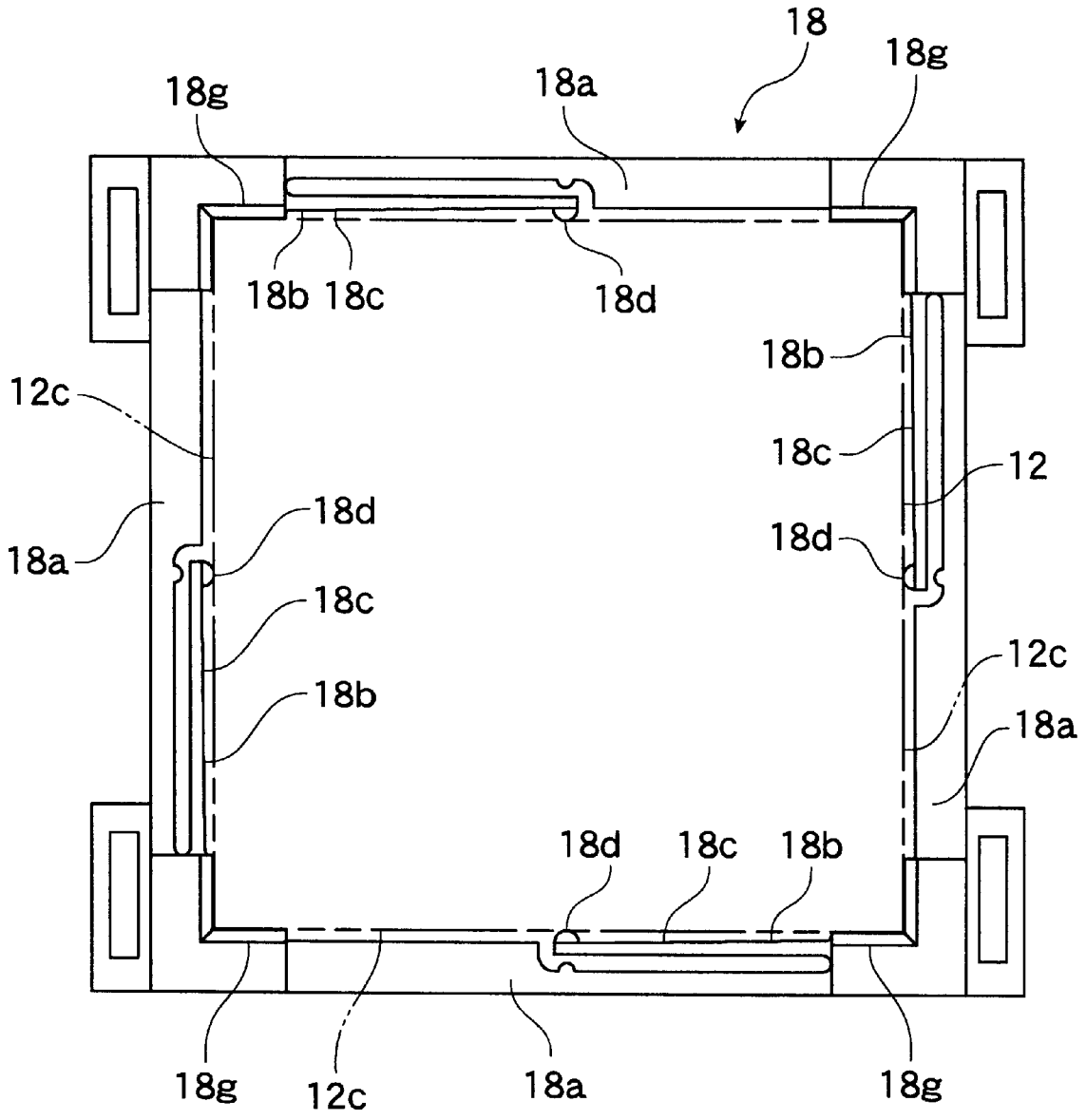
FIG. 16 is a plan view of another variation of a guide member of the IC socket.
Figure 17:
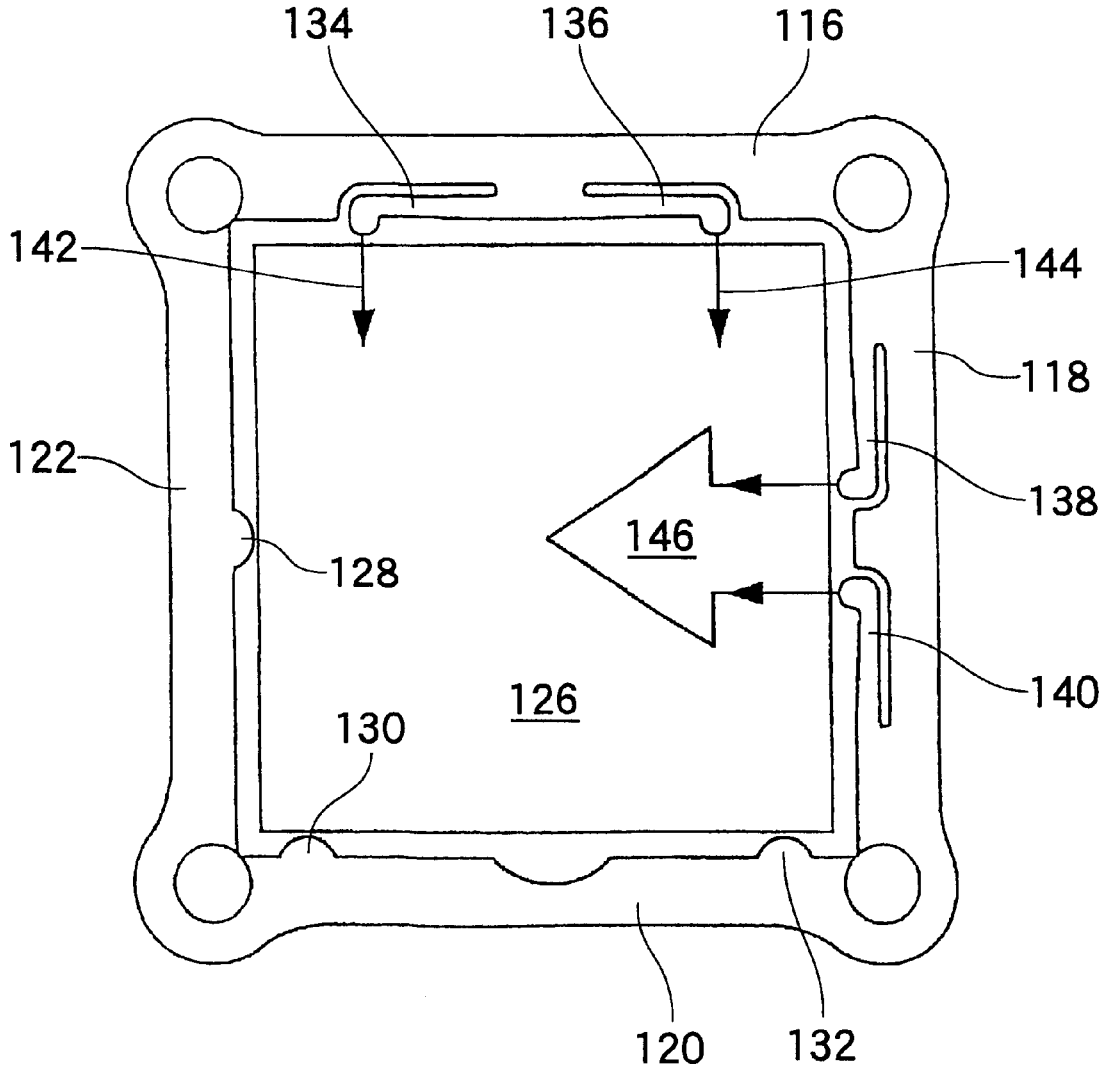
FIG.17 PRIOR ART
FIG. 17 is a plan view showing a conventional example having a structure including wall section of a guide member.

In addition, as is the case. in FIG. 15, a plurality of guide portions can be further positioned adjacently in the vicinity of the guide portions in FIG. 16.

Concerning vectors of the pressing portions opposite to each other across the electrical part body in FIG. 16, the direction of each vector across the electrical part body is just at least opposite to each other and parallel to the center line of the socket body.

Moreover, in the described embodiments, although the guide portions 18*b* are formed to the guide member 18, which is then mounted to the upper plate 16, the guide portions 18*b* may be instead formed to the upper plate 16.

Still furthermore, in the described embodiment, although the guide portions 18*b* are formed integrally with the guide member 18, the present invention is not limited to such embodiment and, in an alternation, coil springs are arranged to the respective side portions 18*a* of the guide member 18, and pressing portions for pressing the electrical part by the urging force of these spring coils may be arranged to thereby constitute a guide unit.

What is claimed is:

1. A socket for an electrical part, which is provided with a socket body for accommodating an electrical part having a body having a surface to which an electrode is formed, and in which a guide member is provided for the socket body so as to guide side surfaces of the body of the electrical part at the time of the accommodating of the electrical part and the socket body is formed with a plurality of contact pins so as to be contacted to or separated from the electrode of the electrical part, wherein said guide member includes a plurality of guide portions, at least one of the guide portions being disposed so as to correspond to each of all the side surfaces of the electrical part body, respectively, to elastically press inward the side surfaces so that a center of the electrical part corresponds to an accommodation center of the socket body, the guide portions each comprising:

a first end portion attached to the socket body, an elastic portion extending substantially in a horizontal direction from the first end portion and having a second end portion, and a pressing portion formed at the second end portion and abutting against the side surface of the electrical part at a time of the accommodating of the electrical part.

2. A socket for an electrical part according to claim 1, wherein each of said elastic portions are elastically deformable and said pressing portion is formed at a front end of the elastic portion, in which said pressing portion abuts against the respective side surface of the electrical part body to press the side surface with an elastic force of the elastic portion.

3. A socket for an electrical part according to claim 1, wherein said guide member has a frame structure and the guide portions are formed to respective sides of the frame structure, said frame structure having a central opening having a size suitable for accommodating the electrical part therein, said frame structure being mounted, to be detachable, to said socket body.

4. A socket for an electrical part according to claim 1, wherein one of the guide portions is arranged to one side surface of the electrical part body and two of the guide portions are arranged to another side surface opposite to the one side surface across the electrical part body, the other two guide portions also being each disposed along a long direction of the another side surface and at each of two outside portions, of the another side surface, from a position opposite to the one of the guide portions across the electrical part body.

5. A socket for an electrical part according to claim 4, wherein a plurality of the guide portions correspond to one of the side surfaces.

6. A socket for an electrical part according to claim 1, wherein two of the guide portions are each arranged to each of two outside portions, from a central portion and along a long direction, of one of the side surfaces of the electrical part body, and another two of the guide portions are each arranged to another side surface of the electrical part body opposite to the one of the side surfaces thereof at each position opposite, across the electrical part body, to the two guide portions arranged to the one of the side surfaces so that the electrical part body is clamped between the two guide portions arranged to the one of the side surfaces and the other two guide portions arranged to the another side surface.

7. A socket for an electrical part according to claim 6, wherein a plurality of the guide portions are arranged to one of the side surfaces.

8. A socket for an electrical part comprising:

a socket body for accommodating an electrical part having a body having a surface to which an electrode is formed;

a guide member having a frame structure provided for the socket body for guiding side surfaces of the electrical part body at a time of the accommodating of the electrical part; and a plurality of contact pins provided for the socket body so as to be contacted to or separated from the electrode of the electrical part, said guide member including a plurality of guide portions disposed at side portions of the frame structure thereof so as to each of correspond to the side surfaces of the electrical part body, respectively, each of said guide portions having an elastic portion to press inward the side surfaces of the electrical part body so that a center of the electrical part corresponds to an accommodation center of the socket body, the guide portions each comprising:

a first end portion attached to the socket body, an elastic portion extending substantially in a horizontal direction from the first end portion and having a second end portion, and a pressing portion formed at the second end portion and abutting against the side surface of the electrical part at a time of the accommodating of the electrical part.

9. A socket for an electrical part according to claim 1, wherein elastic forces of the elastic portions to the respective side surfaces are equal.

10. A socket for an electrical part according to claim 1, wherein the pressing portion comprises a tapered guide surface.

11. A socket for an electrical part according to claim 1, wherein the guide member further comprises a plurality of corner guide portions to guide respective corner portions of the electrical part.

12. A socket for an electrical part according to claim 1, wherein a plurality of the guide members are interchangeable in a single one of the sockets to thereby accommodate a plurality of the electrical parts having different sizes.

13. A socket for an electrical part according to claim 1, wherein the guide member further comprises:

a first side portion having one of the pressing portions; and a second side portion having two of the pressing portions.

14. A socket for an electrical part according to claim 1, wherein two of the pressing portions extend in opposite directions and parallel to a center line of the socket body.

15. A socket for an electrical part according to claim 1, wherein the guide member is a plate and the guide portions are formed thereto.

16. A socket for an electrical part according to claim 1, wherein a plurality of the guide portions are adjacent to each other.

17. A socket for an electrical part according to claim 1, wherein the guide portions are formed integrally with the guide member.

18. A socket for an electrical part according to claim 1, wherein the elastic portion comprises a coil spring.

19. A socket for an electrical part according to claim 1, wherein the guide member further comprises a plurality of side portions, and two of the guide portions are attached to each of the side portions.

20. A socket for an electrical part according to claim 19, wherein each of the pressing portions is opposite a central portion of one of the side portions and spaced therefrom by a predetermined distance.

* * * * *